US006693601B2

(12) United States Patent
Billiet et al.

(10) Patent No.: US 6,693,601 B2
(45) Date of Patent: Feb. 17, 2004

(54) CERAMIC-EMBEDDED MICRO-ELECTROMAGNETIC DEVICE AND METHOD OF FABRICATION THEREOF

(76) Inventors: Romain Louis Billiet, 135A Malacca Street, Penang (MY), 10400; Hanh Thi Nguyen, 135A Malacca Street, Penang (MY), 10400

( * ) Notice: Subject to any disclaimer, the term of this patent is extended or adjusted under 35 U.S.C. 154(b) by 0 days.

(21) Appl. No.: 10/232,239

(22) Filed: Aug. 23, 2002

(65) Prior Publication Data

US 2003/0058187 A1 Mar. 27, 2003

Related U.S. Application Data

(60) Provisional application No. 60/326,340, filed on Sep. 24, 2001.

(51) Int. Cl.[7] ..... H01Q 1/36
(52) U.S. Cl. ..... 343/787; 343/895
(58) Field of Search ..... 343/787, 873, 343/895, 702, 715, 900, 872

(56) References Cited

U.S. PATENT DOCUMENTS

| | | | | |
|---|---|---|---|---|
| 4,725,395 | A | 2/1988 | Gasparaitis et al. | 264/250 |
| 5,341,149 | A | 8/1994 | Valimaa et al. | 343/895 |
| 6,127,979 | A | 10/2000 | Zhou et al. | 343/702 |
| 6,137,452 | A | 10/2000 | Sullivan | 343/873 |
| 6,147,660 | A | 11/2000 | Elliott | 343/895 |

*Primary Examiner*—James Clinger

(57) ABSTRACT

A micro-electromagnetic device is formed by providing internal channels in a ceramic housing sintered from ceramic materials with high dielectric strength and infiltrating these channels with molten metal. The invention allows the fabrication of arrays of ceramic embedded micro-electromagnetic devices as well as ceramic embedded helical micro-antennas designed for use in the high GHz and THz regions at a fraction of the present cost of manufacturing of such devices and with virtually no restriction to their miniaturization.

6 Claims, No Drawings

CERAMIC-EMBEDDED MICRO-ELECTROMAGNETIC DEVICE AND METHOD OF FABRICATION THEREOF

CROSS-REFERENCE TO RELATED APPLICATIONS

This application claims priority to U.S. Provisional Patent Application Serial No. 60/326,340 filed on Sep. 24, 2001.

REFERENCES CITED

| U.S. Patent Documents | | | |
|---|---|---|---|
| 4,435,716 | Mar. 1984 | Zandbergen | 343/895 |
| 4,725,395 | Feb. 1988 | Gasparaitis | 264/250 |
| 5,341,149 | Aug. 1994 | Valimaa et al. | 343/895 |
| 5,648,788 | Jul. 1997 | Bumsted | 343/895 |
| 5,741,249 | Apr. 1998 | Moss et al. | 606/33 |
| 5,986,621 | Nov. 1999 | Barts et al. | 343/895 |
| 6,094,178 | Jul. 2000 | Sanford | 343/895 |
| 6,097,341 | Aug. 2000 | Saito | 343/702 |
| 6,107,966 | Aug. 2000 | Fahlberg | 343/702 |
| 6,107,977 | Aug. 2000 | Tassoudji et al. | 343/895 |
| 6,111,554 | Aug. 2000 | Chufarovsky et al. | 343/895 |
| 6,127,979 | Oct. 2000 | Zhou et al. | 343/702 |
| 6,137,452 | Oct. 2000 | Sullivan | 343/873 |
| 6,147,660 | Nov. 2000 | Elliott | 343/895 |
| 6,150,994 | Nov. 2000 | Winter et al. | 343/895 |
| 6,157,346 | Dec. 2000 | Ho | 343/770 |
| 6,160,516 | Dec. 2000 | Teran et al. | 343/702 |
| 6,160,523 | Dec. 2000 | Ho | 343/770 |
| 6,166,696 | Dec. 2000 | Chenoweth et al. | 343/702 |
| 6,166,709 | Dec. 2000 | Goldstein | 343/895 |
| 6,172,655 | Jan. 2001 | Volman | 343/895 |
| 6,181,296 | Jan. 2001 | Kulisan et al. | 343/895 |
| 6,181,297 | Jan 2001 | Leisten | 343/895 |
| 6,184,845 | Feb. 2001 | Leisten et al. | 343/895 |
| 6,190,382 | Feb. 2001 | Ormsby et al. | 606/33 |
| 6,212,413 | Apr. 2001 | Kiesi | 455/575 |
| 6,219,902 | Apr. 2001 | Memmen et al. | 29/600 |
| 6,299,488 | May 2001 | Lin et al. | 343/700 |
| 6,239,760 | May 2001 | Van Voorhies | 343/742 |
| 6,249,262 | Jun. 2001 | Lee et al. | 343/895 |
| 6,259,420 | Jul. 2001 | Bengtsson et al. | 343/895 |
| 6,271,802 | Aug. 2001 | Clark et al. | 343/895 |
| 6,278,414 | Aug. 2001 | Filipovic | 343/895 |
| 6,278,415 | Aug. 2001 | Matsuyoshi et al. | 343/895 |
| U.S. Patent Application Publications | | | |
| 2001/0005183 | Jun. 2001 | Nevermann et al. | 343/909 |
| Foreign Patent Documents | | | |
| WO 01/56111 | Aug. 2001 | WIPO | |

STATEMENT REGARDING FEDERALLY SPONSORED RESEARCH OR DEVELOPMENT

Not Applicable.

REFERENCE TO A MICROFICHE APPENDIX

Not Applicable.

BACKGROUND—FIELD OF INVENTION

The present invention generally relates to a method for making ceramic-embedded micro-electromagnetic devices such as ceramic-embedded micro-antennas, and the devices made therewith. The present invention is further directed to making a ceramic-embedded helical micro-antenna which is particularly advantageous for use in the upper MHz and THz frequency range.

BACKGROUND—DESCRIPTION OF PRIOR ART

The current wireless revolution is spawning a plethora of new wireless communication and data processing devices making information and voice data instantly available virtually anywhere in the world.

A common feature of such devices is the need for reduced physical size and increased functionality. For example, there is a growing trend to incorporate GPS (Global Positioning Systems) and Bluetooth (TM) technology in consumer electronics devices such as personal digital assistants (PDAs), notebook computers, digital cameras and wireless phones. Bluetooth (TM) is a specification for a small form-factor, low-cost, short-range, cable-replacement radio technology used to link notebook computers, mobile phones and other portable handheld devices, as well as for connectivity to the Internet.

The large number of passives needed for filtering and impedance matching elements associated with these technologies can quickly add up to a significant amount of space and integrating them either on the main printed circuit board (PCB) or on the substrate at a module level can realize important cost and size advantages.

A particularly difficult function to integrate is the antenna. Bluetooth (TM) designers have identified embedded antennas as the most viable alternative. Of all compact antenna configurations, the ceramic embedded helical antenna offers the greatest potential for small size with respectable gain. Embedded antennas are also a rugged and durable solution for compact mobile phones, providing exceptional clarity and being suitable for multi-band reception. They can be unobtrusively hidden within the handset.

Another important issue is the effect of antenna design on SAR (Specific Absorption Rate) levels. Measurements suggest that 40% of the RF power from a mobile phone in either the 800-MHz or 1900-MHz band is absorbed by the user's head when an omni-directional antenna is used. Hence, antennas must be designed so that field emissions in the direction of the user will be below the regulatory limits for maximum SAR. Ceramic embedded antennas can be installed very close to electronic circuits, mechanical objects and human tissue. Their near field is enclosed within the ceramic core of the antenna. This antenna technology also reduces the need for filters and for a large ground plane, thereby lowering component costs and handset interaction. Another notable advantage for handheld mobile telephones is that the ceramic core largely voids detuning when the antenna is brought close to the head of the user.

Portable communicators, such as cell phones, frequently utilize helical or helix antennas. Helical windings permit a relatively long effective antenna length by reducing the helical pitch. This is convenient in cell phones and other portable communicators since small physical size is beneficial and since a certain antenna length is necessary to achieve particular broadcast and reception frequencies.

Helical antennas are usually formed from a thin and delicate conductive wire. Thin wires help preserve the small size and low weight desirable in portable communicators while facilitating low power transmission and reception. This requires the helical conductor to be encased in a protective material, since cell phone antennas are often subjected to forces, which could permanently deform the delicate helical windings.

Based upon the radio frequency response requirements of each individual application, the dimensions of the wire diameter, overall length, outside coil diameter, pitch angle, etc. can be altered.

Helical antennas typically comprise a coil wound around a central core. The process of winding the core is a complicated and expensive process, generally requiring production and assembly of multiple parts and precision winding of a fine wire.

Where circular polarization is desired, the helical antenna has been typically configured as a multi-winding structure comprised of a plurality of concentrically arranged helical windings, each having a fractional number of turns, and terminating the respective windings to a multi-quadrature port hybrid interface.

However, as operational frequencies have reached into the multidigit GHz range, achieving dimensional tolerances in large numbers of identical components has become a major challenge to system designers and manufacturers. For example, in a relatively large number element phased array antenna operating at frequency in a range of 15–35 GHz, and containing several hundred to a thousand or more antenna elements, each antenna element may have on the order of twenty turns helically wound within a length of only several inches and a diameter of less than a quarter of an inch.

While conventional fabrication techniques may be sufficient to form helical windings for relatively large sized applications, they are inadequate for very small sized (multi-GHz applications) where minute parametric variations are reflected as substantial percentage of the dimensions of each element. As a consequence, unless each element is identically configured to conform with a given specification, there is no assurance that the antenna will perform as intended. This lack of predictability is often fatal to the successful manufacture and deployment of a high numbered multi-element antenna structure, especially one that may have up to a thousand elements.

An impressive number of recent inventions cover the design of helical antennas. Simple helical antenna designs are disclosed in Saito, U.S. Pat. No. 6,097,341; Fahlberg, U.S. Pat. No. 6,107,966; Tassoudji et al., U.S. Pat. No. 6,107,977; Chenoweth et al. and U.S. Pat. No. 6,166,696.

Nevermann et al., U.S. Patent Application Publication No. 2001/0005183 and Richter et al., PCT Patent No. WO 01/56111, all describe helical structures composed of strip-shaped flat antenna elements while Filipovic, U.S. Pat. No. 6,278,414 discloses a bent-segment helical antenna.

A dual helical switchable antenna system is taught by Lee et al., U.S. Pat. No. 6,249,262, while Barts et al., U.S. Pat. No. 5,986,621 attempt to reduce the physical outer dimensions of helical antennas by incorporating several incremental folds in the conductor. A dual pitch helical antenna is the subject of Volman, U.S. Pat. No. 6,172,655.

Bengtsson et al., U.S. Pat. No. 6,259,420 describe an antenna system with four interwoven helical wires while Van Voorhies, U.S. Pat. No. 6.239,760 discloses a counter-wound toroidal helical antenna.

In the field of cardiac surgery, Moss et al., U.S. Pat. No. 5,741,249, disclose a microwave ablation catheter incorporating a helical antenna coil adapted to radiate electromagnetic energy in the microwave frequency range. The antenna coil typically has a diameter of about 1.7–2.5 mm. Another catheter system for ablation of body tissues, also incorporating a helical antenna, is disclosed in Ormsby et al., U.S. Pat. No. 6,190,382.

Goldstein, U.S. Pat. No. 6,166,709, attempts to improve on monofilar antenna design in order to obviate the complexities of manufacture of multifilar antennas. Multifilar antennas, used primarily as satellite antennas, require several radiating elements running parallel to each other while spiralling around a common center axis. Bifilar, quadrifilar, hexafilar and multifilar antenna designs are in use. It is very important for the different conductive elements to be held in a precise location with respect to each other both radially and axially. Hence, multifilar antennas are difficult to manufacture at the required tolerance.

Sanford, U.S. Pat. No. 6,094,178; Winter et al., U.S. Pat. No. 6,150,994; Teran, U.S. Pat. No. 6,160,516; Ho, U.S. Pat. No. 6,160,523 and Kiesi, U.S. Pat. No. 6,212,413 all disclose quadrifilar antenna designs while Ho, U.S. Pat. No. 6,157,346 and Matsuyoshi, U.S. Pat. No. 6,278,415 teach a hexafilar and multifilar antenna design respectively.

The problems encountered in multifilar antenna fabrication are exemplified in Sullivan, U.S. Pat. No. 6,137,452 who discloses a multifilar antenna design in which helical grooves on the outer and optionally inner surface of a cylinder made from a non-platable plastic are filled with a platable plastic. The exposed surface of the filled grooves is then plated to form a helical conductor. When the platable plastic is injected into the grooves any surfaces that are not to be coated or filled must be blanked off by the mold cavity walls or cores. Hence the need for high injection velocity and pressure.

For reasons of physical and electrical stability, the material of the antenna core is preferably a microwave ceramic material with a high relative dielectric constant such PZT (lead zirconium titanate), magnesium calcium titanate, barium zirconium tantalate, barium neodymium titanate, or a combination of these. Such materials have negligible dielectric loss to the extent that the Q of the antenna is governed more by the electrical resistance of the antenna than core loss. The actual frequency of resonance of the resonator depends on the relative dielectric constant of the ceramic material forming the core.

With a core material having a relative dielectric strength of about 36, an antenna designed for L-band GPS reception at 1575 MHz typically has a core diameter of about 5 mm and the longitudinally extending antenna elements a longitudinal extent, parallel to the central axis, of about 8 mm. As a result of the very small dimensions of these antennas, manufacturing tolerances may be such that the precision with which the resonant frequency of the antenna can be maintained is insufficient. A significant source of variation in resonant frequency is the variability of the relative dielectric constant of the core material. This usually requires test samples to be produced from each new batch of ceramic.

Zhou et al., U.S. Pat. No. 6,127,979 describe a helical coil antenna fitted with a plastic dielectric core and then insert molded, while Gasparaitis et al., U.S. Pat. No. 4,725,395, teach a helical coil antenna embedded in plastic via a double insert molding operation.

Bumsted, U.S. Pat. No. 5,648,788, recognizing the need for high injection pressures and high injection speeds and the inherent potential for deformation of the coil spring during insert molding, discloses a relatively complex tool assembly on which several coils are positioned. The loaded tool is then manually placed inside the mold, thereby blocking the coils in place during insert molding.

Chufarovsky et al., U.S. Pat. No. 6,111,554 disclose a coil spring first screwed over a plastic core and then insert molded.

Zandbergen, U.S. Pat. No. 4,435,716 teaches a plastic embedded helical antenna by tightly winding a somewhat resilient but deformable conductor wire, typically aluminum wire of 1.6 mm diameter, over a tapered mandrel, removing the wound coil from the mandrel and pulling it through the inner periphery of a hollow frustoconical plastic antenna casing so as to give the coil the desired length and pitch, following which the remaining void inner space is filled with an epoxy.

Valimaa et al., U.S. Pat. No. 5,341,149, also recognizing the potential for thin helical windings to deform during insert molding, disclose a grooved core, around which the helical coil is first wound prior to insert molding the core-coil assembly.

Kulisan et al., U.S. Pat. No. 6,181,296 machine a helical groove in a mandrel. A wire is placed inside the groove and silicone cast around the wound mandrel. After curing of the silicone the mandrel is extracted and a dielectric glass bead-epoxy mixture cast into the silicone mold. After curing, the casting is removed from the silicone mold and used as a dielectric core around which the antenna wire is wound.

Memmen et al., U.S. Pat. No. 6,219,902 disclose a threaded bolt on which a coil spring is screwed to support the latter during insert molding. After molding, the bolt is removed and the space left behind optionally filled with a dielectric core or with plastic.

Lin et al., U.S. Pat. No. 6,229,488 describe a combined helical and patch antenna with a ceramic core, while Leisten et al., U.S. Pat. No. 6,184,845, and Leisten, U.S. Pat. No. 6,181,297, disclose a bifilar and quadrifilar helical antenna with ceramic core respectively.

Elliott, U.S. Pat. No. 6,147,660 attempts to obviate the wire winding step by forming the helical antenna shape directly via the metal injection molding (MIM) process. However, the skilled in the art will instantly realize that this is not so simple. Indeed, regardless of the materials molded, i.e. metals, metal-filled plastics or unfilled plastics, there is obviously a first requirement to provide a mold with a mold cavity insert in the shape of the desired helical coil. Such mold inserts would be extremely difficult and very costly to fabricate, and the more so the smaller the dimensions of the end product.

Furthermore, as is again well known to those skilled in the art, molding a helical path is in itself very difficult, particularly as product dimensions shrink. This is mainly due to the rapid pressure drop in cavities with high aspect ratios such as capillary channels, whether helical in shape or not. The classical spiral mold test used in the plastics industry to evaluate the flow properties of plastic materials is precisely based on the principle of high pressure drop to stop the flow inside the spiral channel. Hence, the filling of a helical mold cavity rapidly becomes impractical or impossible due to the need to apply unusually high injection pressures and temperatures. For the same reasons the ejection of parts molded in helical mold cavities poses serious technical and practical problems.

It will also be obvious to those skilled in the art of metal injection molding, that maintaining shape integrity during sintering of a binder-free green helical coil would pose enormous challenges due to the inherent shrinkage upon sintering, usually in the range of 15–25% linear or about 40–60% by volume. This problem is further exacerbated by the fact that the organic binder in metal injection molded parts must be totally removed from the green parts prior to the onset of sintering. At that moment the residual tensile strength of the green parts is too weak to resist the pull of the earth's gravitational field, resulting in distortion. Only sintering in the low gravity environment of outer space would obviate this problem.

An area of great interest and potential is the THz region of the electromagnetic spectrum with many applications in the medical field, for example, in MRI (Magnetic Resonance Imaging). The current art uses planar microstrip antennas, which do not provide a true 3-D structure needed for performance under certain conditions, e.g. circular polarization in the THz frequency range. Fabrication of helical antennas for this frequency range poses serious technological challenges as dimensions become so small. As an example, typical approximate major dimensions of a helical antenna operating at 1 THz would be:

| | |
|---|---|
| Diameter of the helix: | 100 $\mu$m |
| Spacing of turns in the helix: | 81.3 $\mu$m |
| Diameter of the helix wire: | 15 $\mu$m |

-continued

| | |
|---|---|
| Number of turns: | 5 |
| Pitch angle of the helix: | 13° |

Clark et al., U.S. Pat. No. 6,271,802 describe a method to grow a helical micro-antenna on the surface of a silicon substrate by LCVD (Laser Chemical Vapor Deposition) technology.

In conclusion, as can be inferred from the above review of the prior art, antenna manufacture for advanced wireless applications is strewn with major technological hurdles.

A low-cost method for fabricating ceramic embedded helical antennas and particularly antennas designed to operate in the GHz and THz frequency range would greatly benefit the development of advanced wireless technology.

Furthermore, many other applications requiring small and precisely formed electromagnetic coils would also benefit from such a low cost manufacturing method.

BRIEF SUMMARY OF THE INVENTION

In accordance with the present invention an economic and environmentally benign method is provided to fabricate ceramic-embedded micro-electromagnetic devices by first producing ceramic bodies containing complex capillary helical channels which are subsequently filled with metal.

OBJECTS AND ADVANTAGES

It is a primary object of this invention to provide a micro-electromagnetic device consisting of a ceramic housing incorporating complex internal metal-filled channels.

It is another object of this invention to provide a method to fabricate micro-electromagnetic devices.

Yet another object of the present invention is to provide ceramic-embedded micro-antennas.

Still another object of the present invention is to provide a method to fabricate ceramic-embedded micro-antennas.

The invention allows the fabrication of arrays of ceramic embedded micro-electromagnetic devices as well as ceramic embedded helical micro-antennas design for use in the high GHz and THz regions at a fraction of the present cost of manufacturing of such devices and with virtually no restriction to their miniaturization.

BRIEF DESCRIPTION OF THE SEVERAL VIEWS OF THE DRAWINGS

Not applicable.

DETAILED DESCRIPTION OF THE INVENTION

The first step in the application of this invention is to compound a thermoplastic ceramic mixture, also called thermoplastic ceramic compound, consisting of two distinct and homogeneously dispersed phases, a discrete phase made up of fine particulate ceramic matter, and an organic continuous phase, generally termed the organic binder or simply the binder.

The discrete phase of the thermoplastic compound is made up of at least one finely divided particulate ceramic material, however it may also be made up of mixtures of any number of different ceramic materials. For instance if an yttria stabilized zirconia composition is desired the powder may be a commercially available prealloyed yttria PSZ (Partially Stabilized Zirconia) or a mixture of zirconia and yttria powders. Likewise, if a PZT (Lead Zirconium Titanate) composition is required either a prealloyed PZT powder or a mixture of the elemental constituents may be used. Other ceramic compositions, provided merely as examples and not intended in any way to restrict or limit the scope of application of the present invention include alumina, ZTA (Zirconium Toughened Alumina), boron nitride, cordierite (2 MgO; 2Al2O3; 5SiO2) and steatite (MgO—SiO2).

The main directive in the selection of ingredients for the discrete phase will be the desired composition and material properties of the end product. For example if the end product is an antenna the dielectric properties of the ceramic materials will play a dominant role.

The morphology and particularly the granulometry of the ceramic materials making up the discrete phase of the thermoplastic compound is very important when extremely small product dimensions or complex shapes or extremely tight manufacturing tolerances are attempted. For such parts it may be necessary to further comminute commercially available ceramic powders. For applications in the micrometer or nanometer range or for MEMS applications, nanoparticulate materials may be required.

The continuous phase of the thermoplastic compound is made up of at least one thermoplastic organic material though generally it will be made up of several different organic constituents which may include polyolefin resins, silicones, waxes, oils, greases and the like. In most cases various organic surface active materials (surfactants), plasticizers and antioxidants will also be included to optimize the characteristics of the particulate materials and to avoid or retard premature oxidative degradation of the organic binder. Usually the binder will be specifically formulated for a given discrete phase in order to confer and optimize the thermoplastic compound's properties, such as its rheological behavior, solidification-, glass transition-, flow- and melting temperatures, as well as the thermal decomposition pattern of the organic binder.

The number of combinations and permutations possible at this point are very great and anyone skilled in the art will be well aware of the number of possibilities that exist to them to obtain the desired characteristics of the binder. However, a typical formula for the organic binder mixture would be approximately one-third by weight of polyethylene, one-third by weight of paraffin wax, one-third by weight of beeswax with perhaps 0.1 through 0.2 percent of stearic acid and 0.05% of an antioxidant added.

The discrete particulate ceramic materials and thermoplastic binder ingredients are mixed into a homogeneous mass at a temperature in excess of the melting point or flow point of the thermoplastic materials. Techniques for producing thermoplastic compounds are well described in the prior art and will not be elaborated on here.

The thermoplastic or green compound is formulated in such way that it is a solid at or below the normal room temperatures prevailing in temperate climates, i.e. usually below 25 degrees Celsius. At such temperatures the green compound can be machined by well-known conventional machining techniques such as milling, drilling, turning, reaming, punching, blanking, sawing, cutting, filing and the like.

For cold-forming machining operations such as milling, turning or blanking the thermoplastic mixture can be conveniently shaped into bar stock, billet or plate form at the time of formulation. If necessary, the hardness of the machining stock can be increased, e.g. to facilitate machining, by cooling it prior to machining.

If a heat-assisted forming technique such as casting, molding, laminating or extrusion is employed the green compound is advantageously pelletized first.

The organic binder is formulated so as to be extractable from the thermoplastic or green compound using well-known techniques such as aqueous or organic solvent extraction, oxidative degradation, catalytic decomposition, vacuum distillation, wicking and the like, leaving behind a framework that is substantially devoid of organic material. This binder-free structure can then be sintered to its final dense end configuration in accordance with prior art techniques. During sintering the open porosity, inevitably generated as a result of binder elimination, is gradually eliminated.

It is timely now to point out that green parts processed as noted above will undergo substantial shrinkage upon sintering, usually in the range of 15–25% linear or about 40–60% by volume. Precise control of the shrinkage is crucial in the successful application of this invention.

The second step in the application of this invention is to machine or otherwise shape the said thermoplastic ceramic compound into a green body or housing pierced by a borehole.

The cross section of the borehole can be circular, square, polygonal, oval, elliptical or any other shape that may satisfy the end application. The borehole can be produced by well-known prior art machining techniques such as drilling, punching, reaming, etc.

The third step in the application of the present invention is to provide the inner wall of the borehole with one or several grooves over the entire length of the borehole. The path of the groove or grooves may be straight or curved. A single groove may also bifurcate into two or more grooves and two or more grooves may converge into a single one. The groove or grooves may be produced by well-known prior art machining techniques such as knurling, undercutting, etc.

A preferred embodiment of the present invention is the particular case when the borehole is cylindrical, i.e. the cross section of the borehole is a circle, and the groove or grooves are in the shape of a spiral with constant cross section and regular pitch.

In that particular case the green ceramic body is preferably made by molding it in a cavity equipped with a core threaded to generate the desired groove or grooves. After filling the cavity the threaded core is unscrewed. The grooved borehole in the green ceramic body or housing will thus be formed and can be likened to the rifling in a gun barrel.

The threaded core can be precision ground from a single piece of tool steel. Alternatively, the threaded core can also be formed by tightly precision winding a wire in a helical path with constant pitch around a cylindrical core pin. This will result, after unscrewing of the threaded core from the cavity following molding, in a green ceramic body or housing having a rifled bore, with the rifling being of substantially circular cross section and having substantially the same diameter as that of the wire wound around the core pin.

If such a wound core pin is used to form the rifled bore of the green ceramic body or housing, the total surface area of the borehole located between the individual grooves will be maximized. This is because the wound wire and the core pin are substantially in tangential contact with each other and the area of contact of the wire with the core pin is substantially a linear spiral over the entire length of the core pin. Maximizing this surface area is beneficial to the successful application of this invention.

A preferred embodiment of the present invention is the use of a core pin around which a wire of extremely small diameter has been wound. For example, a gold or aluminum semiconductor bonding wire with a diameter of 25.4 micrometers can be used. A wire of even smaller diameter can be used as there is no limitation to the size of the wire.

Many variations in the shape, size, number, spacing and pitch of spires and the number of spiral grooves in the threaded core pin are possible at this stage and will be immediately obvious to those skilled in the art. What is essential is that the cylindrical threaded or wound core, if used, can be unscrewed from the mold cavity after molding and without disturbing the integrity of the green body or housing.

The fourth step in the application of this invention is to produce a cylindrical core that will be used to plug up the grooved borehole. The plug or core is made from the same thermoplastic compound as the first green body or housing. When inserted into the grooved borehole, the plug will take up all the space of the borehole with exception of the grooves. Hence, a green housing-core assembly having an internal path will have been formed.

Clearly, if the grooved borehole of the green body is not cylindrical, the plug or core will have to be machined so as to precisely match the cross section of the said borehole, allowing for any interference fit.

In the particular case of a cylindrical rifled borehole the diameters of the borehole and of the cylindrical plug or core are substantially identical. In the special case where the threaded core is formed by winding one or several wires around a core pin, the diameter of the cylindrical plug is substantially identical to that of the core pin around which the wire or wires have been wound.

The skilled in the art of mold making will immediately realize the possibility to combine the two molding operations, i.e. for the borehole housing and the matching plug using a single molding tool. For example a dual cavity mold can be designed so that the two green parts, i.e. the green ceramic housing and the green ceramic core are molded simultaneously during a single molding cycle. Upon filling of the respective mold cavities the threaded core is unscrewed from the housing while the mold plate containing the cavity for the plug is brought in line with the axis of the borehole. An ejector pin or other ejecting device then pushes the green plug into the borehole, now freed of its threaded core pin.

It should be noted at this point that a perfect fit between the housing and the plug is crucial to the successful application of this invention. This may require appropriate interference fit tolerancing of the borehole and the mating plug.

It may also be opportune to note at this point that the thermoplastic ceramic compound is subject to a very slight thermal expansion. Typically, the linear expansion over the temperature range from room temperature to typical molding temperatures is less than one percent. The corresponding contraction upon cooling after the cavity has been filled may be put to use in the application of this invention. It is well known that the cooling or heating rate of bodies depends on their cross section. In this case the cross section of the green core or plug will always be less than that of the green ceramic housing. Therefore, the plug will have a tendency to cool faster and contract faster than the housing, thereby rendering the plugging step easier and resulting in a type of press fit. Alternatively, the plug can also be cooled even faster by equipping the mold with appropriate cooling channels. It will now also become apparent to those skilled in the art why maximizing the contact area between the borehole and the matching plug is important and the above noted case where a wire wound core is used to form the borehole will achieve this objective.

The fifth step in the application of this invention is to eject the green housing-core assembly from its mold cavity. The operation can easily be automated.

A preferred embodiment of the present invention is to use the ejected green housing-core assembly as a new plug per se to fit into another green boreholed housing made in the same manner as the first one but of larger dimensions so that the borehole of the new housing can accommodate the first made green housing-core assembly. In this way a new green housing-core assembly having concentric paths, optionally helical, can be produced. The operation can be repeated as many times as desirable resulting in a composite green housing-core assembly with several concentric paths, optionally helical.

Upon ejection from the mold, the green housing-core assembly or composite green housing-core assembly can be further machined or trimmed is desired. Next, the organic binder is extracted from the green housing-core assembly or composite green housing-core assembly and the binderfree preform sintered to substantially full density in accordance with prior art practice. During sintering the surfaces of the grooved boreholes and their mating cores will sinterweld together in much the same way as happens during cofiring of MLC (Multilayer Ceramic) packages for the electronics industry.

As noted above, the shrinkage upon sintering is substantially isotropic and usually in the range of 15–25% linear or about 40–60% by volume. Upon sintering a substantially fully dense ceramic housing having the desired internal channels will have been produced.

The final step in the application of this invention is to infiltrate the internal channels with a molten metal such as for example, an aluminum alloy or copper alloy or gold. The infiltration will preferably take place by capillary action, with or without the use of high or low pressure to assist the metal in filling the channels. A wide range of metals and metallic alloys is available for this purpose and the choice of a particular metal or metallic alloy will usually be governed by the requirements of the end product, economics, availability, electrical conductivity, melting point, etc. Appropriate electrical contacts as may be required for the application can be incorporated on the surfaces of the ceramic housing where the metal-infiltrated paths emerge from the ceramic housing. Such electrical contacts can be applied by screen printing, vapor deposition or any other type of metallization technique commonly used by the prior art.

Conclusion, Ramifications and Scope

The application of the present invention is far reaching and of benefit to a great number of wireless communication applications such as cell telephones, pagers, PDAs, WLANs (wireless local area networks), GPS, wireless computer mice, toys, car alarms, security systems, PGS (Personal Guidance Systems) and Bluetooth (TM) enabled devices.

Other applications of the present invention include micro-transformers, electromagnetic actuators, such as micro-switches, micro-relays, micro-electromagnets, etc.

Another application is for high resolution scanners operating in the far-infrared (FIR) band. Arrays of micro helical antennas produced in accordance with this invention could be used with FIR optical lenses to produce imaging devices.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim as our invention:

1. A method of forming an electromagnetic device comprising the steps of:

a. providing a thermoplastic compound containing at least one sinterable particulate ceramic material and at least one degradable organic thermoplastic ingredient, b. shaping said thermoplastic compound into a green housing traversed by a borehole, c. additionally, shaping said thermoplastic compound into a green core fitting exactly into said green housing borehole but without introducing said green core into said borehole, d. providing the inner wall of said borehole with one or a plurality of grooves over the entire length of said borehole, e. introducing said green core into said rifled borehole to form a green housing assembly having one or a plurality of internal channels constituted by said grooves, f. optionally introducing said green housing assembly into the grooved borehole of another green housing and repeating this process as many times as may be deemed necessary to form a composite green housing assembly, g. removing substantially all of said organic thermoplastic materials from said green housing assembly or composite green housing assembly and sintering said green housing assembly or composite housing assembly into a sintered ceramic housing of substantially full density, h. infiltrating said internal channels of said sintered ceramic housing with a molten metal.

2. The method according to claim 1 wherein said borehole and said core are cylindrical in shape.

3. The method according to claim 2 wherein said grooves in said borehole are in the shape of a regular helix with constant pitch.

4. The method according to claim 3 wherein said helical grooves in said borehole are produced by a threaded core pin.

5. The method according to claim 4 wherein said threaded core pin is constituted by a cylindrical core pin around which a wire has been wound in a regular helical path.

6. The method according to claim 5 wherein said wire is a semiconductor bonding wire of 25.4 mm diameter or less.

* * * * *